US005601498A

United States Patent [19]

Antonious

[11] Patent Number: 5,601,498

[45] Date of Patent: Feb. 11, 1997

[54] GOLF CLUB HEAD WITH SHANKLESS HOSEL

[76] Inventor: Anthony J. Antonious, 7738 Calle Facil, Sarasota, Fla. 34238

[21] Appl. No.: 531,884

[22] Filed: Sep. 21, 1995

Related U.S. Application Data

[63] Continuation of Ser. No. 124,205, Sep. 21, 1993, abandoned.

[51] Int. Cl.[6] ..... A63B 53/04

[52] U.S. Cl. ..... 473/305; 473/350

[58] Field of Search ..... 473/324, 327, 473/349, 350, 287, 290, 291, 314; D21/220; 273/305–315

[56] References Cited

U.S. PATENT DOCUMENTS

| | | | |
|---|---|---|---|
| 302,715 | 8/1889 | Petersen . | |
| 1,135,621 | 4/1915 | Roberst et al. . | |
| 1,594,850 | 8/1926 | Perkins . | |
| 2,495,444 | 1/1950 | Chamberlain | 273/167 F |
| 2,571,970 | 10/1951 | Verderber | 273/162 R |
| 2,882,053 | 4/1959 | Lorthiois | 273/80.1 |
| 2,993,695 | 7/1961 | Birch | 273/80.5 |
| 3,424,459 | 1/1969 | Evancho | 273/80.1 |
| 3,519,271 | 7/1970 | Smith . | |
| 3,720,410 | 3/1973 | Saytar | 273/175 |
| 3,751,035 | 8/1973 | Lockwood | 273/167 R |
| 4,211,416 | 7/1980 | Swanson . | |
| 4,512,577 | 4/1985 | Solheim | 273/167 A |
| 4,540,178 | 9/1985 | Johnson | 273/167 F |
| 4,632,400 | 12/1986 | Boone | 273/169 |
| 5,067,711 | 11/1991 | Parente . | |
| 5,183,255 | 2/1993 | Antonious | 273/167 G |
| 5,326,106 | 7/1994 | Meyer | 273/167 H |
| 5,447,307 | 9/1995 | Antonious | 473/350 |

FOREIGN PATENT DOCUMENTS

| | | |
|---|---|---|
| 447094 | 3/1948 | Canada . |

*Primary Examiner*—Sebastiano Passaniti

*Attorney, Agent, or Firm*— Finnegan, Henderson, Farabow, Garrett & Dunner, L.L.P.

[57] ABSTRACT

A iron-type golf club head for hitting a golf ball. A club head including a hosel permanently and nonrotatably fixed to the body of the club head adjacent the heel portion, the entire hosel being located beyond the outer periphery of the club head with no portion of the hosel extending beyond, in a rear to front direction, the leading edge of the club face. The hosel further includes a tubular shaft socket for accepting a golf club shaft, a socket having interior walls which are spaced from and do not intersect with any portion of the main body of the club head.

44 Claims, 5 Drawing Sheets

FIG. 7
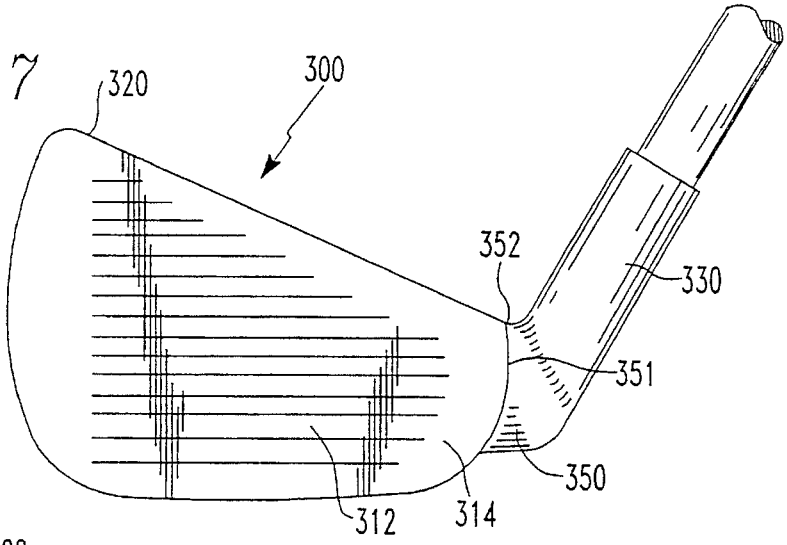
FIG. 7A
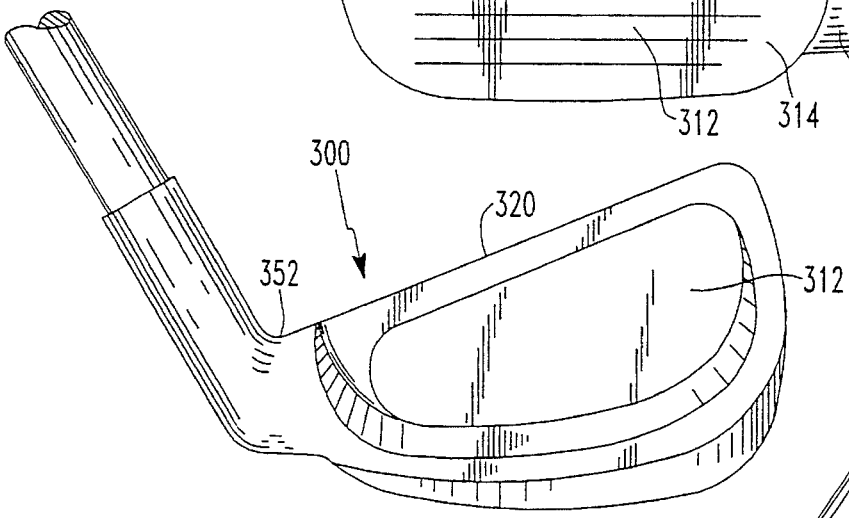
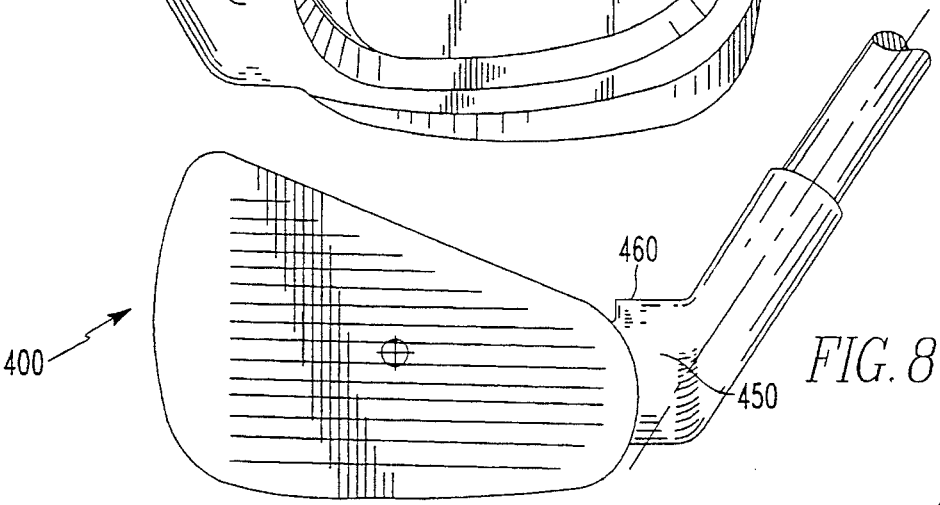
FIG. 8
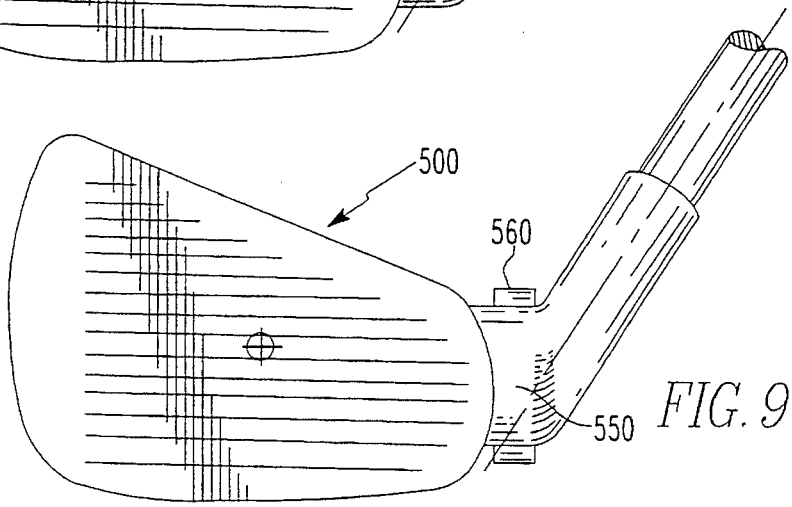
FIG. 9

#1 IRON

#5 IRON

PW

#5 IRON

PW

#1 IRON

GOLF CLUB HEAD WITH SHANKLESS HOSEL

This application is a continuation of application Ser. No. 08/124,205 filed Sep. 21, 1993, now abandoned.

BACKGROUND OF THE INVENTION

1. Field of the Invention

The present invention relates to golf club irons, and in particular, to an iron type golf club having an improved hosel construction.

2. Description of the Related Art

Conventional iron golf club heads use a hosel with a shank portion formed below the shaft socket, which normally extends directly into the heel portion of the club head. This produces the off-set-type hosel that exposes the shank portion of the hosel that protrudes beyond the club face, whereby golf shots hit at this critical heel area cause the ball to veer off in an eccentric direction after striking the pocket between the club head face and the hosel. Hence, the resulting "shank" golf shot is dreaded by those who play the game. The "shank" golf shot occurs because conventional club heads are normally offset rearwardly from the hosel center line and have a rearward face progression. Most conventional sets of iron golf clubs using this principle have progressive rearward face progression in accordance with the loft of the iron. Using these conventional irons, the ball may be "shanked" when the club face is swung outside the intended swing line, causing the ball to be struck in the pocket formed between the shank portion of the hosel and the club head face There have been numerous attempts to produce golf club heads which are "shank proof," including my own patent, U.S. Pat. No. 5,183,255, relating to a golf club with an improved hosel construction wherein the hosel is positioned behind the ball striking face at the heel portion, and the center line of the hosel intersects with a plane or loft of the ball striking face proximate the club head center of gravity.

Another patent directed to a shankless club is U.S. Pat. No. 1,550,501 to Byrne, which shows a golf club head wherein the hosel is located completely behind the ball striking face, producing a club head wherein the ball striking face is entirely ahead of the shaft center line. As shown in the drawings of Byrne, the shaft connects to the hosel above the club head body.

Another patent of interest is U.S. Pat. No. 2,683,036 to Kline, which discloses a golf iron wherein the hosel is located well behind the ball striking face and the longitudinal axis of the hosel is behind or fully to the rear of the club head. Kline teaches that a portion of the heel of the club head extends beyond the hosel, and the shaft connects to the hosel above at least the heel portion of the club head.

Another patent of interest is U.S. Pat. No. 3,946,041 to Barber, wherein a bridging portion connecting the hosel and the club head is formed so that the bridging portion and the hosel present in their golf ball contacting surfaces an essentially flat surface continuous with the surface of the club face. In Barber, a downward extension of the center line of the club shaft intersects the club head and is taught to intersect the plane defined by the club face in the lower quadrant. As shown, the shaft extends into the hosel to a point above the club head body.

Yet another patent, U.S. Pat. No. Des. 302,715 to Petersen, shows a low-lofted iron wherein the hosel connection is essentially an extension of the ball striking face.

The shaft extends into the hosel and terminates above the club head body.

Yet another patent of interest is U.S. Pat. No. 4,211,416 to Swanson, which discloses a golf club in which the blade is connected to the shaft of the club by a hosel extending rearwardly from the rear face of the blade at the heel end and then inclined away from the heel and forwardly and upwardly to position the bottom end of the club shaft forward and above the upper end of the blade. Swanson expresses the opinion that such a hosel will minimize the lever arm or torque arm tending to twist the blade upon impacting the ball. The patent explains that the forward mounting of the shaft positions the shaft axis in a plane which passes through the center portion or sweet spot of the blade. It explains that the shaft of the club is positioned in a plane ahead of the top edge of the blade.

Other patents of interest are U.S. Pat. No. 1,594,850 to Perkins; U.S. Pat. No. 1,135,621 to Roberts; and Canadian Patent 447,094 to Nilson. Each of these patents discloses a single, adjustable golf club head in which the hosel and shaft of the club are rotatably connected to the club head so that the loft of a single club may be varied, as desired.

SUMMARY OF THE INVENTION

The general object of the present invention is to provide a shankless iron-type club head that improves upon the prior art, including the above described clubs. Another object of the present invention is to provide an improved iron-type golf club head which does not include a shank portion in the hosel and which has improved structural and functional characteristics over the prior art. Yet another object is to provide a club head with an elongated, completely unencumbered ball striking face within the standard size limitations of traditional size club heads.

To achieve these and others advantages and in accordance with the purpose of the invention, as embodied and broadly described herein, the invention is directed toward an iron-type golf club head for hitting a golf ball comprising a golf club head having a heel portion, a toe portion, a body, a sole, a top ridge, and a planar lofted ball striking face having a loft greater than 12 degrees, the ball striking face intersecting with a forwardmost progression of the bottom sole to define a leading edge of the ball striking face of the golf club head, the most outward exterior surfaces of the heel portion, toe portion and ball striking face defining an outer periphery of the club head. The golf club head of the present invention includes a hosel permanently and nonrotatably fixed to the body adjacent the heel portion, the entire hosel being located beyond the outer perimeter of the club head, the hosel including a front surface, a rear surface, and an inward, toe-facing surface. No portion of the hosel extends beyond, in a rear to front direction, the leading edge of the club face. The hosel includes a tubular shaft socket for accepting a golf club shaft, the socket having interior walls which are spaced from and do not intersect with any portion of the club head body.

In a preferred embodiment, the hosel is connected to the golf club body by an elbow portion positioned between the heel of the golf club body and the hosel, the entire portion of the elbow being positioned in line with or behind the leading edge of the golf club face. The elbow portion connects the hosel to the club head body and spaces the hosel from the outer periphery at the heel portion of the club head body. The lower surface of the elbow is preferably spaced upwardly from the bottom sole of the club head body.

The elbow provides increased leverage between the longitudinal axis of the club shaft and the center of gravity of the club head, without requiring an enlarged club head that increases drag. In addition, the elbow is preferably structured to reduce vibration and permit optimum weight placement of the various components of the club head, to provide improved control and feel and greater strength. For example, the elbow can include a buffer portion to reduce vibration, shock and torque at impact and permit precise overall club head weight distribution.

In all of the various embodiments of a golf club head of the present invention, the golf club shaft extends substantially into the socket of the hosel to a point well below the top of the club head and preferably at or below the center of gravity of the club head. In addition, the entire club shaft with the hosel is located behind an extension of the leading edge of the club face.

In a preferred embodiment, the tubular socket extends downwardly to a point that is aligned with the center of gravity of the club head body. In addition, in the preferred embodiment, the top of the hosel is positioned below the highest point of the club head, thereby concentrating additional weight and mass more proximate the club head's center of gravity.

The present invention thus relates to an iron-type golf club head having a hosel, preferably an angular elbow-type hosel, without a shank type portion, the hosel being located beyond the heel portion of the ball striking face of the club head in a heel to toe direction. The frontal surface of the hosel is either in line with or set back behind the leading edge of the golf club face, so that the club face has forward face progression. The hosel is generally tubular in shape and includes a tubular shaft socket, which extends substantially downwardly to permit the end of the shaft to be located adjacent the bottom of the hosel or through it, while keeping the shaft spaced from the club head itself and the sole of the club head. Preferably, the hosel is substantially straight throughout its length, the tubular shaft socket is substantially concentric with the body of the hosel, and the extended longitudinal axis of the tubular shaft socket does not intersect with any portion of the club head body.

The combination of these as well as other structural innovations described in this application permits a golfer to achieve optimum transfer of potential force at impact. This represents a significant improvement, particularly when ball contact is made toward or at the extreme heel area of the club face. The "shank" shots of conventional iron clubs are eliminated, and the so-called "sweet spot" on a golf club is enlarged considerably by providing a greater hitting area on the club face without increasing the traditional size of the club face and/or the overall club head size. This provides a unique club head which remains of a conventional size and therefore creates less drag, producing greater club head speed. The substantially enlarged "sweet spot" area of this traditional-sized club head, combined with the other unique innovations of this club head, dramatically increase the overall performance of the club. Since ball contact can be made anywhere on the club face, the confidence a golfer will develop with such clubs results in more effective club head contact repeatedly, which will produce more solid shots that travel straighter and further on a consistent basis.

Additional features and advantages of the invention will be set forth in the description which follows, and in part will be apparent from the description, or may be learned by practice of the invention. The objects and other advantages of the invention will be realized and obtained by the combinations particularly pointed out in the written description and claims, as well as the drawings.

Both the foregoing general description and the following detailed description are exemplary and explanatory only. The accompanying drawings are included to provide a further understanding of the invention and are incorporated in and constitute part of the specification to illustrate several embodiments of the invention and, together with the description, serve to explain the principles of the invention.

BRIEF DESCRIPTION OF THE DRAWINGS

FIG. 7 is a front view of a third embodiment of an iron-type golf club head of the present invention.

FIG. 7A is a rear view of the iron-type golf club head of FIG. 7

FIG. 8 is a front view of a fourth embodiment of an iron-type golf club head of the present invention.

FIG. 9 is a front view of a fifth embodiment of an iron-type golf club head of the present invention.

DETAILED DESCRIPTION OF THE INVENTION

Reference will now be made in detail to the present preferred embodiments of the invention, examples of which are illustrated in the accompanying drawings. Wherever possible, like references will be used to refer to like parts.

Figure 1:
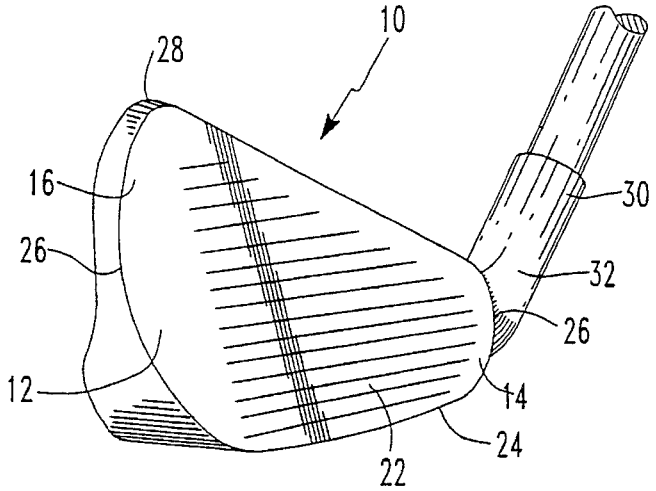
FIG. 1 is a perspective view of a first embodiment of an iron-type club head according to the present invention.
Figure 2:
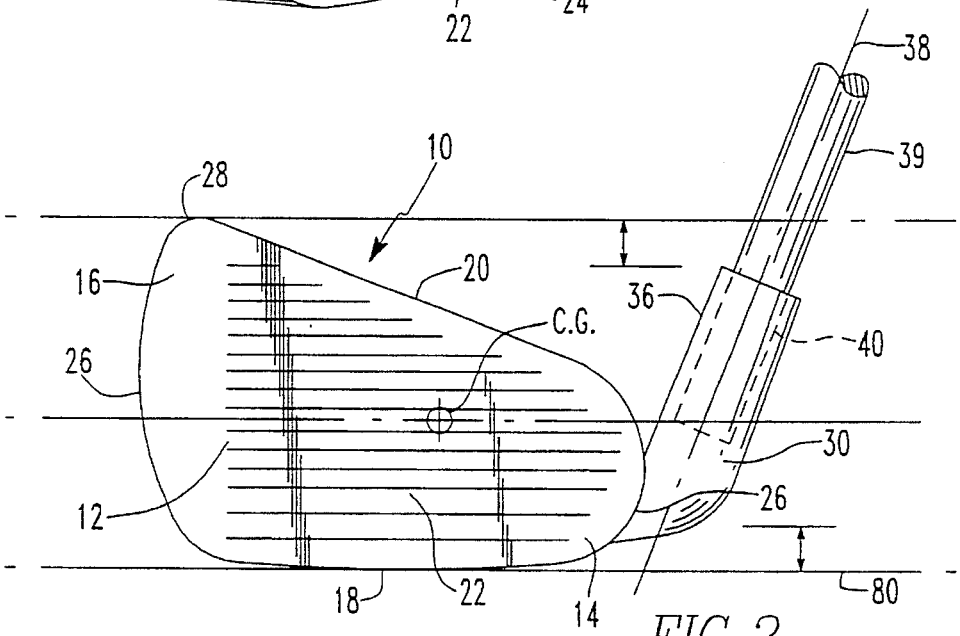
FIG. 2 is a front view of the iron-type golf club head show in FIG. 1.
Figure 3:
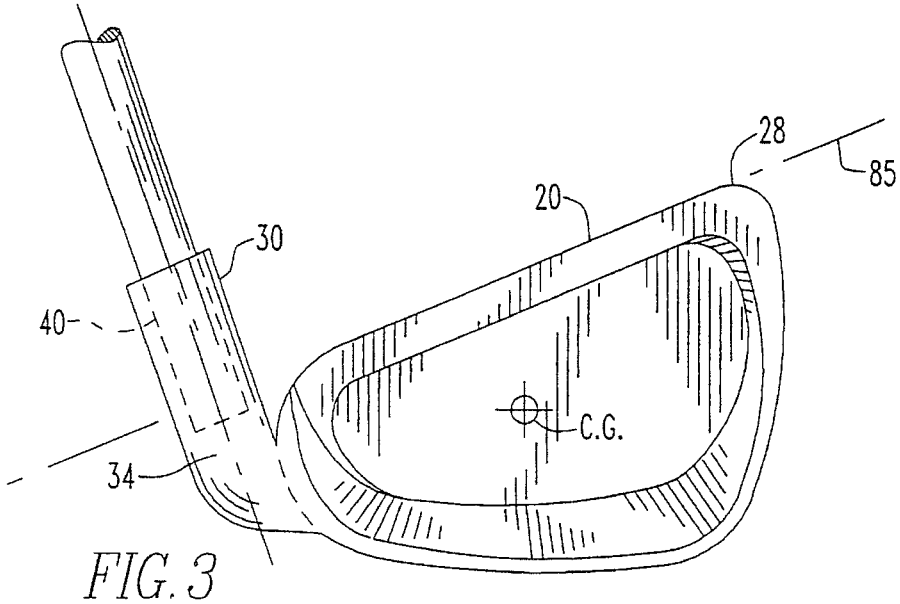
FIG. 3 is a rear view of the iron-type golf club head of FIG. 1.

Referring to the drawings, FIGS. 1 through 3 show a first embodiment of a typical cavity-backed weighted golf club head 10 made in accordance with the present invention. The golf club head includes a golf club head body 12 having a heel portion 14, a toe portion 16, a bottom sole 18, a top ridge 20, and a planar, lofted ball striking face 22 having a loft greater than 12 degrees. The ball striking face 22 intersects with a forwardmost progression of the bottom sole 18 to define a leading edge 24 of the golf club face. The most outward exterior surfaces of the heel portion, toe portion, and ball striking face define an outer periphery 26 of the club head, which extends completely around the club head.

As shown in FIGS. 1–3 the entire ball striking face 22 of the club head is planar from the toe 16 to the heel 14. The club head includes a hosel 30 that is permanently and nonrotatably fixed to the body adjacent the heel 14, the entire hosel being located beyond the outer periphery 26 of the club head. The hosel 30 includes a front surface 32, a rear surface 34, and an inward-toe facing surface 36. As shown in the figures, the forwardmost front surface 32 and indeed the entire hosel 30 is located in line with or behind the leading edge 24 in the direction from the ball striking face to the rear of the club head. As a result, no portion of the hosel 30 extends beyond, in a rear to front direction, the leading edge 24 of the golf club. The positioning of the hosel 30 outside the outer periphery 26 of the club head eliminates any possible interference between the hosel and a ball being struck on the club head face 22. This improvement creates a substantially larger "sweet-spot," which dramatically minimizes or eliminates club head torqueing or twisting for off-center hits. Greater leverage can be obtained with the same amount of swing force to execute the desired golf shot. More power is transferred at impact resulting in more distance and accuracy when ball contact is made. A significantly improved club head is obtained in the present invention by eliminating "shanking" and minimizing severe "slicing" and "hooking" regardless where ball contact is made on the club face.

As shown in FIGS. 2 and 3, the hosel includes a tubular shaft socket 40 for accepting a golf club shaft. The shaft socket is preferably concentric with the body of the hosel. The socket has interior cylindrical walls which are spaced from and do not intersect with any portion of the club head body. Most preferably and as shown in FIG. 2, the extended longitudinal axis 38 of the tubular shaft socket does not intersect with any portion of the club head body. As a result, the shaft does not connect directly into the heel portion of the club head.

The hosel 30 of the present invention is preferably substantially straight throughout its length. The hosel also is preferably shorter than conventional hosel structures, thereby concentrating more weight closer to an area where a golf ball would be ideally struck on the club face. As shown in FIGS. 1–3, the top of the hosel 30 (particularly for low and mid lofted clubs) preferably is positioned below the uppermost toe portion 28 of the golf club head and intersects the club head body 12 below a line 85 parallel to and coincident with the top ridge 20. Preferably, the top of the hosels for the number 2 through 5 irons of a set of clubs made according to the present invention is positioned below, preferably at least one quarter of an inch below, the uppermost toe portion 28. In addition, the bottom of the hosel 30 is preferably positioned above, more preferably positioned at least a quarter of an inch above, a line 80 defined by the extension of the leading edge. This preferred spacing is shown generally in FIG. 2. It is further preferable that the longitudinal length of the hosel 30 be no greater than 2 inches. As a result, the mass of the hosel is more proximate the center of gravity of the club head body itself.

As shown in the Figures, various modifications of the tubular shaft socket can be incorporated in the present invention. Generally, it is preferable that the tubular shaft socket extends at least to a point at or below the center of gravity of the club head. In the embodiment shown in FIGS. 1–3, the tubular shaft socket terminates at a closed end that is positioned at or below a line defined by an extension of the top ridge 20 and is generally aligned with the center of gravity of the club head. In this embodiment and in others described hereinbelow, the end of the club head shaft is located more proximate the center of gravity and center of percussion of the club head, than many prior designs of conventional or "shankless" club heads. In a preferred embodiment, the hosel is no longer than two inches in length, and the corresponding shaft socket is no longer than 1.5 inches in depth.

Figure 4:
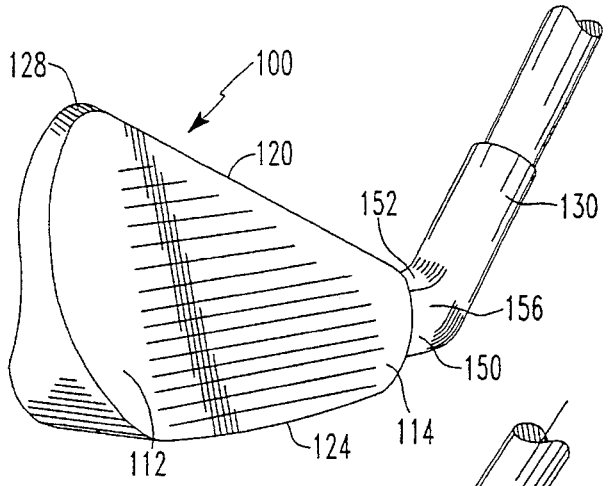
FIG. 4 is a perspective view of a second embodiment of an iron-type golf club head according to the present invention.
Figure 5:
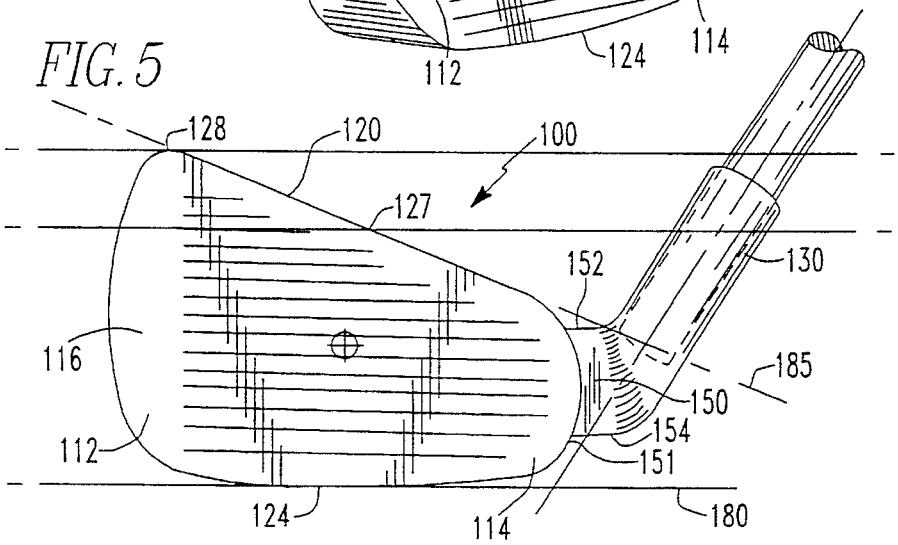
FIG. 5 is a front view of the iron-type golf club head of FIG. 4.

FIGS. 4 and 5 illustrate a second embodiment of a golf club head 100 in accordance with the present invention. This golf club head is similar to that shown in FIGS. 1 through 3, except that the club head includes an elbow 150, which is positioned between the heel 114 and hosel 130 of the club head and below the upper portion of the heel and hosel of the club head. The elbow 150 connects the heel 114 and hosel 130 but also spaces the hosel from the outermost edge 151 of the heel. As shown in FIGS. 4 and 5, the elbow 150 includes an upper surface or top 152 and a lower surface or bottom 154. Preferably, the upper surface 152 is positioned below the uppermost toe portion 128 of the club head, more preferably below the midpoint 127 of top ridge 126. Similarly, in the preferred embodiment, the lower surface of the elbow 150 is spaced upwardly from a line 180 defined by an extension of the leading edge 124. The elbow preferably is at least one eighth of an inch wide, in a toe to heel direction, and more preferably at least a quarter of an inch wide. The elbow preferably has a height, in a sole to top ridge direction, of at least half an inch. The elbow preferably extends in a direction generally parallel to the leading edge of the club face in a heel 114 to toe 116 direction. In the preferred embodiment, the front surface 156 of the elbow 150 is generally parallel to but spaced behind the ball striking face of the club head.

The elbow serves as a connector and further increases the distance between the hosel and the heel of the club head, thereby further minimizing any possibility of a golf ball being struck against the hosel if an extremely faulty swing is made by a golfer. The use of the elbow also facilities the bending of the hosel to alter the lie or loft of the club head. Through the use of the elbow, the distance from the axis of the shaft to the center of gravity of the club head is increased without enlarging the club face size, thereby providing a club head having an increased leverage effect, without the increased drag and weight resulting from enlarged club heads.

The entire portion of the elbow preferably is positioned behind the leading edge of the club face and integrally connects the outermost edge of the heel to the hosel. Preferably, the bottom surface of the elbow is aligned with the bottom surface of the hosel.

Figure 5A:
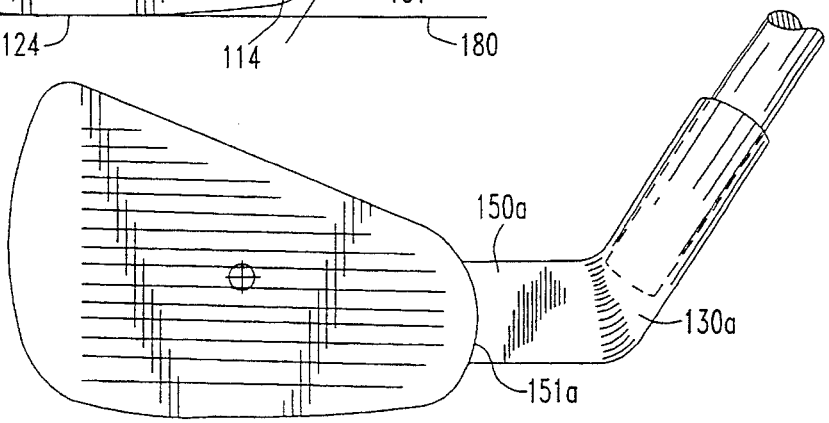
FIG. 5A shows an alternate embodiment of FIG. 5.

FIG. 5A shows an embodiment, similar to FIG. 5, using an elongated elbow 150A which exceeds one-half inch in length between the outer periphery of heel portion 151A and the lower outermost edge of hosel 130A.

Figure 6:
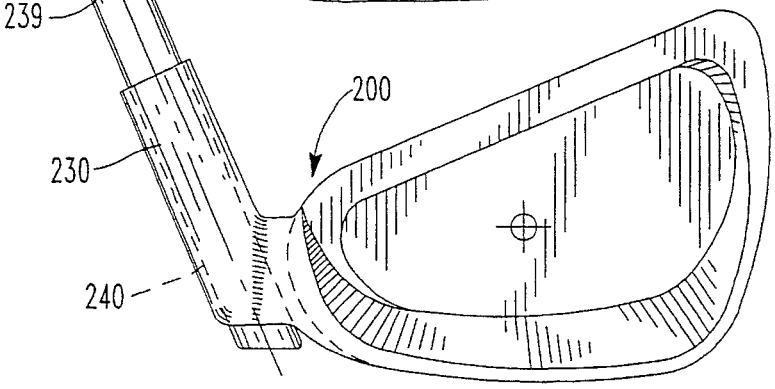
FIG. 6 is a rear view of the iron-type golf club head of FIG. 4, with the exception that FIG. 6 shows an alternative embodiment of the shaft socket in the hosel.
Figure 10A:
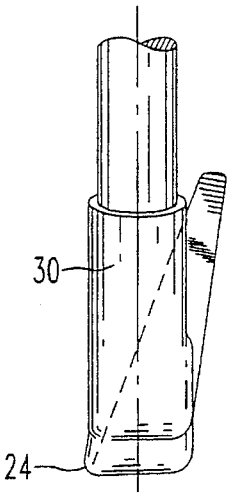
FIGS. 10*a* through 10*f* are heel views and top views, respectively, of selected irons of a set of clubs made according to an embodiment of the present invention.
Figure 10B:
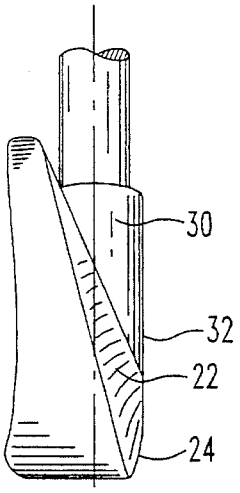
Figure 10C:
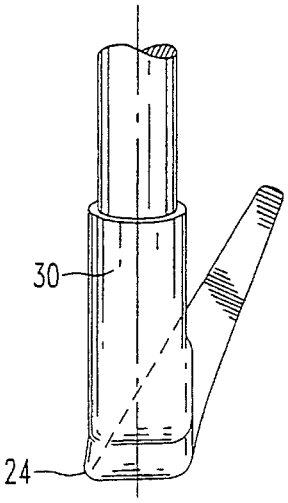
Figure 10D:
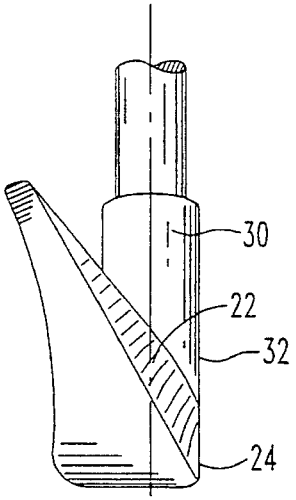
Figure 10E:
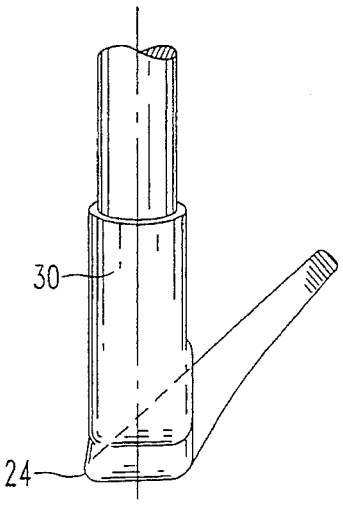
Figure 10F:
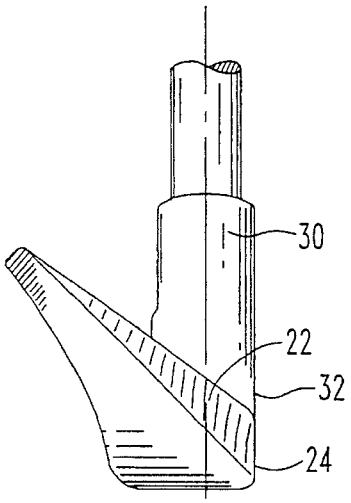
Figure 11A:
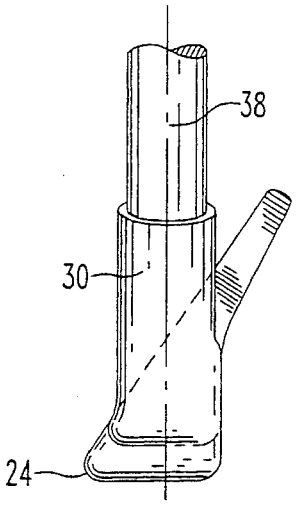
FIGS. 11*a* through 11*f* are heel views and top views, respectively, of selected irons in a set of clubs made according to another embodiment of the present invention.
Figure 11B:
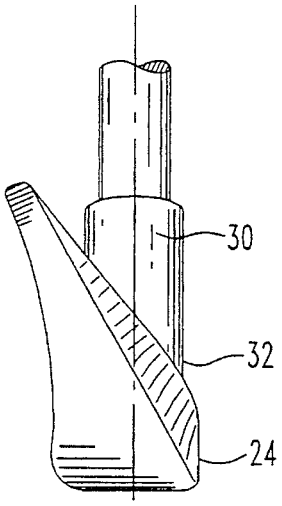
Figure 11C:
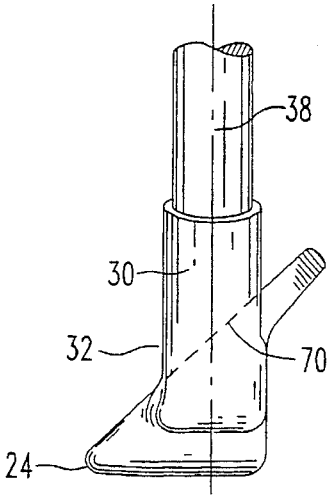
Figure 11D:
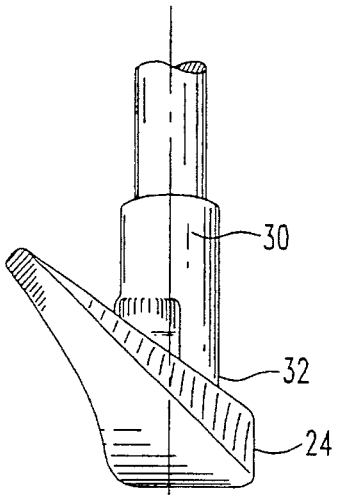
Figure 11E:
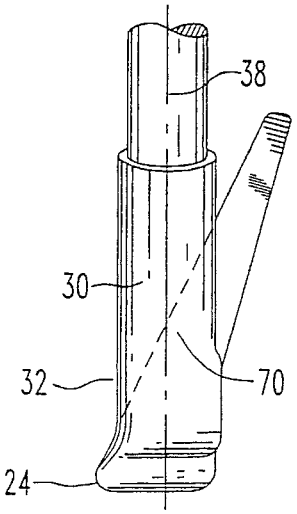
Figure 11F:
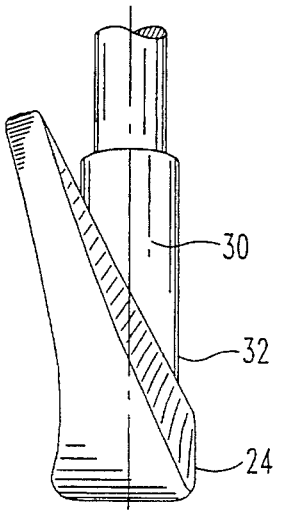

FIG. 6 shows another embodiment of a golf club head 200 in accordance with the present invention which is similar in structure to the embodiment of FIGS. 4 and 5, except the tubular shaft socket 240 extends completely through the hosel 230 permitting the shaft 239 to extend to or beyond the bottom of the hosel.

FIGS. 7 and 7A show a further embodiment of a golf club head 300, again similar to the embodiment of FIGS. 4 and 5, wherein the elbow 350 of the hosel 330 is connected to the club head body 312 and is shaped to conform to the outer periphery 351 at the heel portion 314 of club head 300. In the embodiment shown in FIGS. 7 and 7A, the uppermost surface 352 of the elbow is coincident with and is in alignment with an extension of the top ridge 320 of the club head, thereby raising the hosel and the center of gravity of the club head and more evenly distributing the club head weight about the club head's center. This combination of features provides a club head having an enlarged sweet spot, thus providing a more forgiving club when balls are hit off center.

In a slightly modified embodiment to that shown in FIGS. 7 and 7A, the uppermost surface of the elbow can be positioned slightly below a line parallel to and coincident with the top ridge 320.

FIGS. 8 through 9 show further embodiments of the present invention, wherein the elbow between the hosel and the heel includes a buffer portion to provide optimum weight distribution and strength characteristics. The buffer also can be designed to reduce vibration, shock, and torque at impact, which may be caused by striking a golf ball off the ideal center of percussion of the club head.

In the embodiment shown in FIG. 8, the club head 400 includes a buffer portion 460 incorporated in the upper and back portion of the elbow 450, while in the embodiment shown in FIG. 9, the club head 500 uses a buffer portion 560 incorporated in the top and bottom portion of the elbow 550. In this embodiment, the buffer portion extends along substantially the entire width (toe to heel direction) of the elbow and extends along a portion of the back portion of the elbow, in a vertical direction. The buffer portion in FIG. 9 adds more mass to the club head generally below the club head's center of gravity, while the buffer portion in FIG. 8 adds more mass to the club head generally above the club head's center of gravity. Although the back of the buffer can take a variety of shapes, in the preferred embodiments, the buffer takes a generally half-washer-like shape in which the buffer extends outwardly and rearwardly from the rear of the rest of the elbow. In the embodiment shown in FIG. 9, the buffer portion extends above and below the rest of the elbow, has a width that is less than the width of the elbow, and is symmetrically located about the traverse (toe to heel) axis of the elbow.

The various embodiments of the golf club heads of the present invention can be incorporated into an entire set of iron-type clubs, typically including a 1 iron through a pitching wedge, lob wedge, and/or sand wedge. Examples of a partial set of clubs made according to the present invention are shown in FIGS. 10*a* through 10*f* and 11*a* through 11*f*, respectively. In both of these figures, a 1 iron, 5 iron, and a pitching wedge of a set of clubs are shown.

As shown in FIG. 10, any of the various embodiments set forth in FIGS. 1 through 9, as well as any other embodiments of the present invention, can be incorporated into a set of irons in which the forwardmost front surface 32 of the hosel 30 of each club head in the set is generally in alignment with the leading edge 24 of the club face 22. In such a club set, the distance between the axis of the shaft and the leading edge of the club is essentially the same, throughout the entire set of clubs, whether the clubs be ones which include no elbow, an elbow, or an elbow with a buffer. FIGS. 10*b* and 10*f* illustrate clubs that do not have a buffer portion, while FIG. 10*d* illustrates a club head having a buffer portion like that shown in FIG. 8.

As shown generally in FIG. 11, any of the embodiments can be ones in which the axis of the shaft socket and the hosel 30 progressively moves backward relative to the leading edge 24 as the club head loft (and club number) in the set increases. As shown, the entire hosel in each iron shown, and indeed the entire set, is located behind the leading edge of the club face. In addition, in the preferred embodiment shown, the longitudinal axis 38 of the shaft socket of the hosel intersects proximately with the extended center 70 of the striking face. In the most preferred embodiment, the club heads of the set are designed with a weight distribution such that the shaft axis substantially intersects not only with the extended center of the striking face but also with the center of gravity of the club head. In the partial set shown in FIG. 11, the front surface 32 of the hosel 30 progressively is located further from (in a front to rear direction) the leading edge of the club face 24, as the loft (and club number) of the club heads of the set increases.

Although the invention is described with respect to a peripheral weighted club head, it will be appreciated that it is equally applicable to non-cavity-backed designs, including forged heads, muscle-back heads, and other similar well known club head designs.

In addition, although the invention can be applied to club heads of any size, in the preferred embodiment the disclosed hosel, elbow, and/or buffer arrangements are incorporated into a standard sized club face, rather than an enlarged club face.

The present invention thus provides an iron-type golf club head, and a set of such club heads, having a truly shankless hosel. The shankless elbow type hosel is also located in line with or behind the leading edge of the club face, so the club head has a forward face progression unlike conventional golf clubs, which are normally off-set rearwardly from the hosel center line and which have a rearward face progression. A further feature of the invention is that the bottom of the shaft socket formed in the tubular elbow-type hosel extends substantially downward toward the bottom of the hosel or through it, while keeping the shaft spaced from the club head and the sole of the club head.

The addition of an elbow extends the hosel even further away from the heel portion of the club face and permits golfers to obtain more leverage without increasing the size of the club face. The use of the additional buffer reduces vibration, shock and torque, and provides more cushioning to the club head at impact, while also allowing optimum weight distribution. The buffer also adds more weight to the elbow to provide for better ball control and optimum overall club head balance for each club. By varying the size and location of the buffer, the location of the center of gravity or center of percussion of the club heads within a set can be precisely arranged.

It will be apparent to those skilled in the art that other modifications and variations can be made in the golf club head of the present invention without departing from the spirit of scope of the invention. Thus, it is intended that the present invention cover the modifications and variations of this invention provided these come within the scope of the appended claims and their equivalents.

I claim:

1. An iron type golf club head for hitting a golf ball comprising:

a golf club head body having a heel portion, a toe portion, a bottom sole, a top ridge, and a planar, lofted ball striking face having a loft greater than 12 degrees, the ball striking face intersecting with a forwardmost progression of said bottom sole to define a leading edge of the ball striking face of said golf club head, the most outward exterior surfaces of said heel portion, toe portion and ball striking face defining an outer periphery of the club head;

a hosel permanently and nonrotatably fixed to said body adjacent said heel portion, the entire hosel being located beyond the outer periphery of the club head, said hosel including a top, a bottom, a front surface, a rear surface, and an inward, toe-facing surface;

no portion of said hosel extending beyond, in a rear to front direction, the leading edge of the club face; and said hosel including a tubular shaft socket for accepting a golf club shaft, said tubular shaft socket having interior walls and an extended longitudinal axis, said walls and axis being spaced from and not intersecting any portion of the club head body.

2. The golf club head of claim 1 wherein said hosel is substantially straight throughout its longitudinal length and said tubular shaft socket is substantially concentric with said hosel.

3. The golf club head of claim 1 wherein said tubular shaft socket terminates at a closed end positioned at or below a line defined by a point where said hosel abuts the top ridge at the heel portion.

4. The golf club head of claim 1 wherein said tubular shaft socket extends to a closed end positioned at or below the center of gravity of the club head.

5. The golf club head of claim 1 wherein said tubular shaft socket extends through the entire length of said hosel.

6. The golf club head of claim 1 wherein said tubular shaft socket terminates at a closed end generally aligned with the center of gravity of the club head.

7. The golf club head of claim 1 wherein the bottom of said hosel is positioned above a line defined by an extension of the leading edge of the club face.

8. The golf club head of claim 1 wherein the bottom of said hosel is positioned at least one-quarter inch above a line defined by an extension of the leading edge of the club face.

9. The golf club head of claim 1 wherein the top of said hosel is positioned below the top ridge at the toe portion of the club head.

10. The golf club head of claim 9 wherein the top of said hosel is positioned at least one quarter of an inch below the top ridge at the toe portion of the club head.

11. The golf club head of claim 9 wherein said hosel is no longer than two inches in length.

12. The golf club head of claim 11 wherein the tubular shaft socket is no longer than one and a half inch in length.

13. The golf club head of claim 1 wherein the bottom of said hosel is positioned above a line defined by an extension of the leading edge of the club face and the top of said hosel is positioned below a line from the top ridge at the toe portion of the club head and extending in a direction horizontal to the bottom sole.

14. The golf club head of claim 1 wherein the entire hosel is behind, in a front to rear direction, the leading edge of the club face.

15. The golf club head of claim 1 further comprising an elbow having a bottom portion, a top, and a front surface, the elbow positioned between the heel portion of the golf club body and said hosel and connecting said hosel to said heel portion, no portion of said elbow extending beyond, in a rear to front direction, the leading edge of the club face, wherein the hosel is spaced from the outer periphery of said heel by means of said elbow.

16. The golf club head of claim 15 wherein the bottom portion of said elbow is positioned above a line defined by an extension of the leading edge of the club face.

17. The golf club head of claim 15 wherein the front surface of said elbow is generally parallel to the ball striking face adjacent said elbow.

18. The golf club head of claim 15 wherein the bottom portion of said elbow is positioned above a line defined by an extension of the leading edge and the top of said hosel is positioned below the uppermost toe portion of the club head.

19. The golf club head of claim 15 wherein the entire elbow is behind, in a front to rear direction, the leading edge of the club face.

20. The golf club head of claim 15 wherein said elbow is at least one-eighth of an inch wide, in a toe to heel direction.

21. The golf club head of claim 15 wherein said elbow is at least one quarter of an inch wide, in a toe to heel direction.

22. The golf club head of claim 15 wherein said elbow is at least half of an inch in height, in a sole to top ridge direction.

23. The golf club head of claim 15 wherein the top of said elbow is positioned below the midpoint of the top ridge of the club head.

24. The golf club head of claim 16 wherein the top of said elbow extends above a point on the top ridge of the club head.

25. The golf club head of claim 16 wherein the top of said elbow is below an extended horizontal line from a point where the top ridge of the club head abuts the heel portion.

26. The golf club head of claim 16 wherein the elbow includes an integral buffer portion that extends outwardly from the remaining portion of the elbow, providing a more concentrated mass where the buffer portion is located.

27. The golf club head of claim 26 wherein said buffer portion extends above and rearwardly from the remaining portion of said elbow.

28. The golf club head of claim 26 wherein said buffer portion extends below and rearwardly from the remaining portion of said elbow.

29. The golf club head of claim 26 wherein the elbow includes a traverse axis and said buffer portion is symmetrically located about the traverse axis of said elbow.

30. The golf club head of claim 26 wherein said buffer portion extends above and below the remaining portion of said elbow.

31. An iron type golf club head for hitting a golf ball comprising:

a golf club head body having a heel portion, a toe portion, a bottom sole, a top ridge, and a planar, lofted ball striking face having a loft greater than 12 degrees, the ball striking face intersecting with a forwardmost progression of said bottom sole to define a leading edge of the ball striking face of said golf club head, the most outward exterior surfaces of said heel portion, toe portion and ball striking face defining an outer periphery of the club head;

a substantially straight hosel permanently and nonrotatably fixed to said body adjacent said heel portion, the entire hosel being located beyond the outer periphery of the club head, said hosel including a top, a bottom, a front surface, a rear surface, an toe-facing surface;

no portion of said hosel extending beyond, in a rear to front direction, the leading edge of the club face;

said hosel including a tubular shaft socket for accepting a golf club shaft, said tubular shaft socket being substantially concentric with said hosel and having interior walls and an extended longitudinal axis, said walls and axis being spaced from and not intersecting any portion of the club head body, said tubular shaft socket extending to a point at or below a line defined by an extension of the top ridge; and an elbow positioned between the heel portion of the golf club body and said hosel and connecting said hosel to said heel portion, no portion of said elbow extending beyond, in a rear to front direction, the leading edge of the club face, wherein the hosel is spaced behind said heel portion, in a toe to heel direction, by means of said elbow.

32. The golf club head of claim 31 wherein the bottom of said hosel is positioned above a line defined by an extension of the leading edge of the club face.

33. The golf club head of claim 31 wherein the bottom of said hosel and said elbow are both positioned above a line defined by an extension of the leading edge and a top of said elbow is positioned below the midpoint of the top ridge.

34. The golf club head of claim 33 wherein the elbow includes an integral buffer portion that extends outwardly from the remaining portion of the elbow, providing a more concentrated mass where the buffer portion is located.

35. The golf club of claim 32 wherein said elbow joins said club head body and an uppermost surface of said elbow lies below a line parallel to and coincident with the top ridge.

36. The golf club of claim 32 wherein said elbow joins said club head body and an uppermost surface of said elbow is coincident with and is in alignment with said top ridge adjacent with said heel portion of said club head body.

37. The golf club of claim 31 wherein the overall length of said elbow exceeds one-half inch between the outer periphery of the heel and the lower outermost edge of said hosel.

38. An iron type golf club head for hitting a golf ball comprising:

a golf club head body having a heel portion, a toe portion, a bottom sole, a top ridge, and a planar, lofted ball striking face having a loft greater than 12 degrees, the ball striking face intersecting with a forwardmost progression of said bottom sole to define a leading edge of the ball striking face of said golf club head, the most outward exterior surfaces of said heel portion, toe portion and ball striking face defining an outer periphery of the club head;

a hosel permanently and nonrotatably fixed to said body adjacent said heel portion, the entire hosel being located beyond the outer periphery of the club head, said hosel including a top, a bottom, a front surface, a rear surface, and an inward, toe-facing surface;

no portion of said hosel extending beyond, in a rear to front direction, the leading edge of the club face;

said hosel including a tubular shaft socket for accepting a golf club shaft, said tubular shaft socket having interior walls which are spaced from and do not intersect any portion of the club head body; and an elbow having a bottom portion, a top, and a front surface, the elbow positioned between the heel portion of the golf club body and said hosel and connecting said hosel to said heel portion, no portion of said elbow extending beyond, in a rear to front direction, the leading edge of the club face, wherein the hosel is spaced from the outer periphery of said heel by means of said elbow, the bottom portion of said elbow is positioned above a line defined by an extension of the leading edge of the club face.

39. The golf club head of claim 38 wherein the bottom portion of said elbow is positioned above a line defined by an extension of the leading edge and the top of said hosel is positioned below the uppermost toe portion of the club head.

40. An iron type golf club head for hitting a golf ball comprising:

a golf club head body having a heel portion, a toe portion, a bottom sole, a top ridge, and a planar, lofted ball striking face having a loft greater than 12 degrees, the ball striking face intersecting with a forwardmost progression of said bottom sole to define a leading edge of the ball striking face of said golf club head, the most outward exterior surfaces of said heel portion, toe portion and ball striking face defining an outer periphery of the club head;

a hosel permanently and nonrotatably fixed to said body adjacent said heel portion, the entire hosel being located beyond the outer periphery of the club head, said hosel including a top, a bottom, a front surface, a rear surface, and an inward, toe-facing surface;

no portion of said hosel extending beyond, in a rear to front direction, the leading edge of the club face;

said hosel including a tubular shaft socket for accepting a golf club shaft, said tubular shaft socket having interior walls which are spaced from and do not intersect any portion of the club head body; and an elbow having a bottom portion, a top, and a front surface, the elbow positioned between the heel portion of the golf club body and said hosel and connecting said hosel to said heel portion, no portion of said elbow extending beyond, in a rear to front direction, the leading edge of the club face, wherein the hosel is spaced from the outer periphery of said heel by means of said elbow, the elbow including an integral buffer portion that extends outwardly from the remaining portion of the elbow, providing a more concentrated mass where the buffer portion is located.

41. The golf club head of claim 40 wherein said buffer portion extends above and rearwardly from the remaining portion of said elbow.

42. The golf club head of claim 40 wherein said buffer portion extends below and rearwardly from the remaining portion of said elbow.

43. The golf club head of claim 40 wherein the elbow includes a traverse axis and said buffer portion is symmetrically located about the traverse axis of said elbow.

44. The golf club head of claim 40 wherein said buffer portion extends above and below the remaining portion of said elbow.

* * * * *